United States Patent [19]

Rusnak

[11] Patent Number: 4,951,866

[45] Date of Patent: Aug. 28, 1990

[54] FOOD CONTAINER AND METHOD

[75] Inventor: Eileen M. Rusnak, La Grange Park, Ill.

[73] Assignee: Restaurant Technology, Inc., Oak Brook, Ill.

[21] Appl. No.: 267,898

[22] Filed: Nov. 7, 1988

[51] Int. Cl.[5] ..... B65D 1/34

[52] U.S. Cl. ..... 229/120.07; 206/561; 220/4 B; 220/22.1; 220/22.2; 220/23; 229/2.5 R; 229/120.32; 229/902; 426/120

[58] Field of Search ..... 426/115, 119, 120, 128, 426/129; 229/120.07, 120.06, 120.32, 2.5 R, 902, 904, 906, DIG. 13; 220/22, 22.3, 23, 22.1, 4 B, 4 E; 53/226 R, , 377, 467, 474, 484; 206/561

[56] References Cited

U.S. PATENT DOCUMENTS

| | | | |
|---|---|---|---|
| D. 224,554 | 8/1972 | Swett | D44/1 |
| D. 241,820 | 10/1976 | Jewel | D9/219 |
| D. 241,822 | 10/1976 | Jewell | D9/235 |
| D. 246,560 | 12/1977 | Beauchamp et al. | D7/76 |
| D. 251,657 | 4/1979 | Jewell | D9/219 |
| D. 252,913 | 9/1979 | Barcliff | D9/184 |
| D. 253,456 | 11/1979 | Payne | D9/182 |
| D. 254,776 | 4/1980 | Edwards | D9/183 |
| D. 256,097 | 7/1980 | Amberg | D9/219 |
| D. 258,722 | 3/1981 | Commisso et al. | D9/423 |
| D. 259,543 | 6/1981 | Commisso et al. | D9/426 |
| D. 263,023 | 2/1982 | Commisso | D9/347 |
| D. 263,684 | 4/1982 | Davis | D9/426 |
| D. 263,798 | 4/1982 | Edwards | D9/426 |
| D. 274,889 | 7/1984 | Sullivan[4] | 229/2.5 R |
| D. 277,167 | 1/1985 | Dart | D9/347 |
| D. 278,412 | 4/1985 | Yeung | D9/420 |
| D. 285,414 | 9/1986 | Goetz et al. | D9/420 |
| 604,388 | 5/1898 | Hamilton . | |
| 678,325 | 7/1901 | White . | |
| 707,062 | 8/1902 | Heineman . | |
| 897,458 | 9/1908 | Dickeson . | |
| 944,145 | 12/1909 | Nemsey . | |
| 981,744 | 1/1911 | Bowditch . | |
| 1,319,024 | 10/1919 | Warfield . | |
| 1,706,334 | 3/1929 | Toch . | |

(List continued on next page.)

FOREIGN PATENT DOCUMENTS

| | | | |
|---|---|---|---|
| 927789 | 6/1973 | Canada | 217/162 |
| 959458 | 12/1974 | Canada | 217/179 |
| D40599 | 4/1976 | Canada . | |
| 1061264 | 8/1979 | Canada | 190/26 |
| 1075646 | 4/1980 | Canada | 217/12 |
| 1100424 | 5/1981 | Canada | 190/35 |
| 1232579 | 2/1988 | Canada | 217/12 |
| 1242675 | 10/1988 | Canada | 217/162 |
| 825459 | 12/1951 | Fed. Rep. of Germany . | |
| 1225103 | 9/1966 | German Democratic Rep. | 229/2.5 R |

OTHER PUBLICATIONS

International Paper Divided Container, Design Date Approximately 1985.

Sweetheart Divided Container, Design Date Approximately 1985.

James River Foam Divided Container, Design Date Approximately 1985.

James River Paper Board Divided Container, Design Date Approximately 1985.

Dopaco Divided Container, Design Date Approximately 1985.

Traex, Design Date Approximately 1985.

U.S. Appl. Ser. No. 07/027345 to Cyr filed 03/18/87.

*Primary Examiner*—Gary Elkins

*Attorney, Agent, or Firm*—Jenner & Block

[57] ABSTRACT

A compartmented container and method of packaging is provided.

The container in one embodiment has first and second compartments and a removable insert to separate the two compartments. In the closed position, the second compartment is on top of the first compartment. The insert is removable when the container is closed and includes a support tab that is insertable into a slot in the container to restrain movement of the insert and to distribute forces through the sidewalls of the container.

19 Claims, 3 Drawing Sheets

U.S. PATENT DOCUMENTS

| | | | |
|---|---|---|---|
| 2,008,429 | 7/1935 | Weatherhead, Jr. | 220/22.1 |
| 2,114,530 | 4/1938 | Gorton, Jr. | 99/174 |
| 2,457,043 | 12/1948 | Histand | 206/545 |
| 2,510,211 | 6/1950 | Cleary | 229/15 |
| 2,575,192 | 11/1951 | Shepard | 229/2.5 R |
| 2,631,939 | 3/1953 | Peters | 99/171 |
| 2,852,177 | 9/1958 | Frasch | 229/15 |
| 3,292,810 | 12/1966 | Schechter | 220/4 |
| 3,310,905 | 3/1967 | Davis et al. | 220/4 B |
| 3,351,265 | 11/1967 | Miller | 229/43 |
| 3,360,115 | 12/1967 | Joffe . | |
| 3,360,153 | 12/1967 | Wheaton, Jr. | 220/4 B |
| 3,381,873 | 5/1968 | Hirota | 229/2.5 |
| 3,394,869 | 7/1968 | Fontana et al. | 229/51 |
| 3,567,013 | 3/1971 | Tannenbaum | 206/42 |
| 3,730,418 | 5/1973 | Spencer | 229/27 R |
| 3,746,241 | 7/1973 | Seymour | 229/15 |
| 3,829,003 | 8/1974 | Dilot | 229/31 R |
| 3,858,717 | 1/1975 | Peters | 206/44.12 |
| 3,933,296 | 1/1976 | Ruskin et al. | 229/2.5 R |
| 3,961,708 | 6/1976 | Von Dohlen et al. | 229/2.5 R |
| 3,999,661 | 12/1976 | Jones | 229/2.5 R |
| 4,079,880 | 3/1978 | Edwards | 229/45 R |
| 4,081,077 | 3/1978 | Franck | 206/219 |
| 4,094,454 | 6/1978 | Snyder | 229/15 |
| 4,132,344 | 1/1979 | Jewell | 229/2.5 R |
| 4,137,333 | 1/1979 | Daswick | 426/120 |
| 4,143,165 | 3/1979 | Daswick | 426/113 |
| 4,226,358 | 10/1980 | Ottow | 229/44 |
| 4,234,097 | 11/1980 | Daenen | 220/4 D |
| 4,241,863 | 12/1980 | Faller | 229/2.5 R |
| 4,265,216 | 5/1981 | Marshall et al. | 126/263 |
| 4,335,842 | 6/1982 | Bradford et al. | 229/15 |
| 4,465,190 | 8/1984 | Cillario | 206/526 |
| 4,585,124 | 4/1986 | Pride | 206/559 |
| 4,653,685 | 3/1987 | Leary et al. | 229/2.5 R |
| 4,708,248 | 11/1987 | Davis | 206/549 |
| 4,844,330 | 7/1989 | Roosa et al. | 229/120.06 |

FOOD CONTAINER AND METHOD

FIELD OF THE INVENTION

This invention relates to a container. More particularly, in one embodiment, the invention relates to a food container having two compartments that are especially adapted for separately containing the contents of the two compartments.

BACKGROUND OF THE INVENTION

For containing certain materials, including various types of foods and especially foods that are served at quick service restaurants, it would be desirable to have a segregated container or package to keep portions of the contained material separate. It would be especially desirable to have such a container for food, such as a hamburger sandwich, in which the relatively hot (or moist) portion of the sandwich is segregated from the relatively cool (or dry) portion of the sandwich, where the sandwich can easily be loaded and enclosed in the container.

In addition, a need exists for such a container or package that is easy and simple to utilize, which contains the packaged material or food without deformation of the contents and where the contents can be assembled easily by the consumer.

SUMMARY OF THE INVENTION

In accordance with the present invention, a container or package that is especially suitable for containing food is provided. In accordance with one embodiment, the container or package comprises a first or bottom compartment defined by a bottom portion and side portions with an open portion opposite the bottom portion. A second or top compartment is provided that is defined by a bottom portion and side portions and an open portion opposite the bottom portion. The second or top compartment is adapted to lie over the open portion of the first compartment with the open portion of the first compartment facing the open portion of the second compartment to close the container.

A removable insert, which may be a platform, is positionable over the open portion of one of the compartments when the container is open. The insert has a gripping tab on its periphery that extends beyond at least one of the side portions of the container to facilitate removal of the insert when the insert is positioned between the first and second compartments. Removal is accomplished by grasping the tab portion and pulling the insert from the container while the container is closed. The contents of the top and bottom compartments are thereby combined, without further handling by the consumer.

The container further includes a support tab that projects from the periphery of the removable insert, preferably opposite the gripping tab, for supporting the insert in the container. A slot is provided in a side portion of the container and is located and dimensioned to permit insertion of the supporting tab when the removable insert is in position between the open portions to restrain movement of the insert.

In accordance with another embodiment of the invention, a container or package is provided that is especially suitable for containing the sandwich. The package comprises first and second compartments, each of which is defined by a bottom portion and side portions with each compartment having an open portion opposite the bottom portion. The second compartment includes a slot in one of its side portions adjacent the open portion of the second compartment.

A hinge mechanism connects side portions of the first and second compartments to permit the second compartment to be folded over and onto the first compartment to define an enclosed volume that comprises the first and second compartments with the bottom of the second compartment defining the top of the closed package.

A removable platform is provided that is positionable over the open portion of the second compartment. The platform has a support tab that projects from the periphery of the platform and is dimensioned to allow insertion of the tab into the slot when the platform is positioned over the open portion of the second compartment for restraining the platform from movement and for at least partially supporting the weight of the platform and the weight of any contents located in the second compartment. The tab further prevents the contents of the second compartment from moving the platform away from the second compartment when the package is closed by folding the second compartment over and onto the first compartment.

The package may further comprise a gripping tab on the periphery of the platform, opposite the support tab, that extends beyond at least one of the side portions of the package when the platform is in position in the slot and over the opening of the second compartment, for facilitating removal of the platform from the package when the package is closed. The gripping tab also facilitates support of the platform in conjunction with the support tab and transfers at least a portion of the weight of the platform and any contents in the compartment to the side portions of the package.

The support tab, in conjunction with the gripping tab, can serve to prevent the platform from being urged into the first compartment when the package is closed, thereby preventing contact and deformation of any contents contained in the first compartment.

In accordance with still another aspect of the present invention, a method of packaging a sandwich that includes top and bottom portions is provided The method includes obtaining a container for the sandwich as previously described, thereafter placing the bottom portion of the sandwich into the bottom compartment and placing the top portion of the sandwich into the top compartment, while the container is open. After placing the top portion of the sandwich into the second or top compartment, the support tab of the insert or platform is inserted into the slot and placed over the open portion of the second or top compartment. Thereafter, the container is closed by folding the top compartment over and onto the bottom compartment while urging the grasping tab against the side portion of the second compartment while the supporting tab in the slot prevents the insert from moving away from the second compartment.

The method in accordance with the invention can be easily accomplished by a human operator and requires only one hand of the human operator to be utilized in order to maintain the insert in position against the side portion of the top compartment during the closing.

The method can further include assembly of the contents of the two compartments by removing the support tab from its slot and removing the platform from the container. Removal of the tab and platform can be accomplished while the container is closed by pulling the insert out of the container.

DETAILED DESCRIPTION

Figure 1:
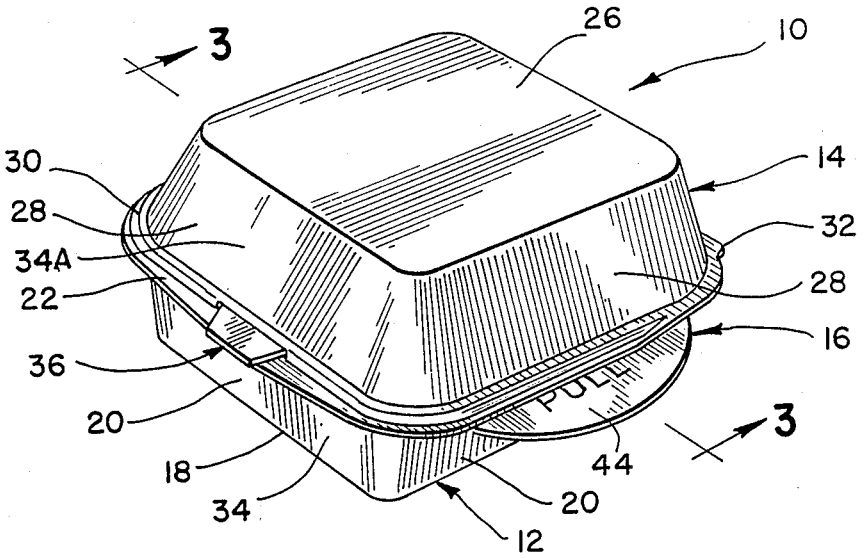
FIG. 1 illustrates in perspective view a container in accordance with the invention in a closed position.

Referring to the figures generally, and in particular to FIG. 1, there is illustrated in perspective view the sandwich container or package 10. Sandwich container 10 is illustrated in a closed, latched position and is composed of a first or bottom compartment 12, a second or top compartment 14 and an insert 16, which in this case is an insulating platform.

Figure 3:
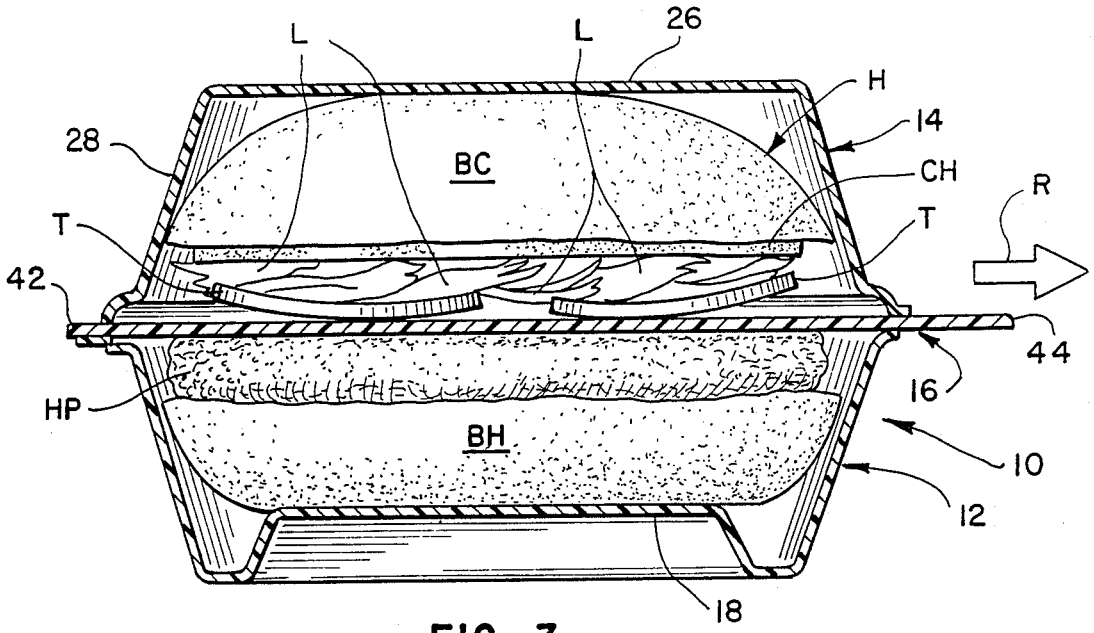
FIG. 3 is a cross-sectional view along lines 3—3 of FIG. 1 showing a hamburger sandwich in position being separated by the insert.
Figure 5:
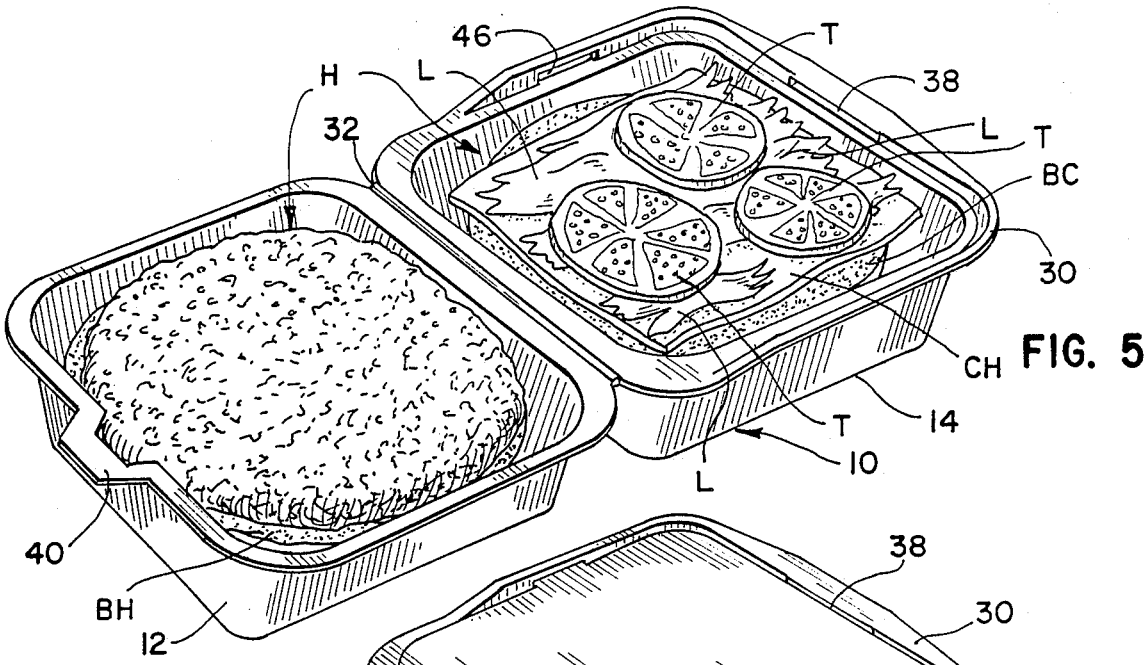
FIG. 5 illustrates in perspective view the container of FIG. 1 in an open position after the top and bottom portions of the sandwich have been placed into the respective compartments.

First or bottom compartment 12 is composed of a bottom portion or wall 18 and side portions 20, which in this case are upwardly extending side walls that terminate with an outwardly extending lip surface 22, as better illustrated in FIG. 5. Side portions 20, as illustrated in FIG. 3, extend slightly outwardly as they extend upwardly.

In the illustrated embodiment, bottom portion 18 includes a trough 24 extending around the periphery of the interior of bottom portion 18. Trough 24 serves to collect any fluids that may drain from the contents and raise bottom portion 18 to facilitate removal of the contents. Bottom portion 18 could also be ribbed (not shown) in addition or in place of trough 24 for providing a space between the contents and bottom portion 18 as well as for providing for airflow and fluid collection.

Top compartment 14 includes a top surface 26 and side portions 28 which in this case are downwardly extending side walls that terminate at a lip surface 30 that is complementary to lip surface 22 of bottom compartment 12.

Bottom and top compartments 12 and 14 are joined together by a hinge section 32 which can be integrally formed in the material of which bottom and top compartments 12 and 14 are formed. Such a hinge is well known in the art, for example, see U.S. Pat. No. 4,132,344, the disclosure of which is hereby incorporated by reference thereto. Hinge 32 is almost as wide as sandwich container 10, which promotes stability of and facilitates closing of container 10.

Front wall portions 34 and **34*a* of bottom and top compartments 12 and 14, respectively, have structure that defines a latch mechanism 36. Latch mechanism 36 includes a locking aperture 38 in top compartment 14 and a locking latch 40 that extends from lip surface 22 of bottom compartment 12. Locking aperture 38 is dimensioned to receive locking latch 40** therein. Such a latch mechanism is well known in the art and thus is not described in detail. For example, such a latch is illustrated in U.S. Pat. No. 4,132,344.

Hinge 32 allows top compartment 14 to be folded over and onto bottom compartment 12 to close sandwich container 10 as illustrated in FIG. 1. Hinge 32 also permits the container to be opened by lifting and pivoting top compartment 14 about hinge 32 to an open position, as illustrated in FIG. 5, for example.

Figure 2:
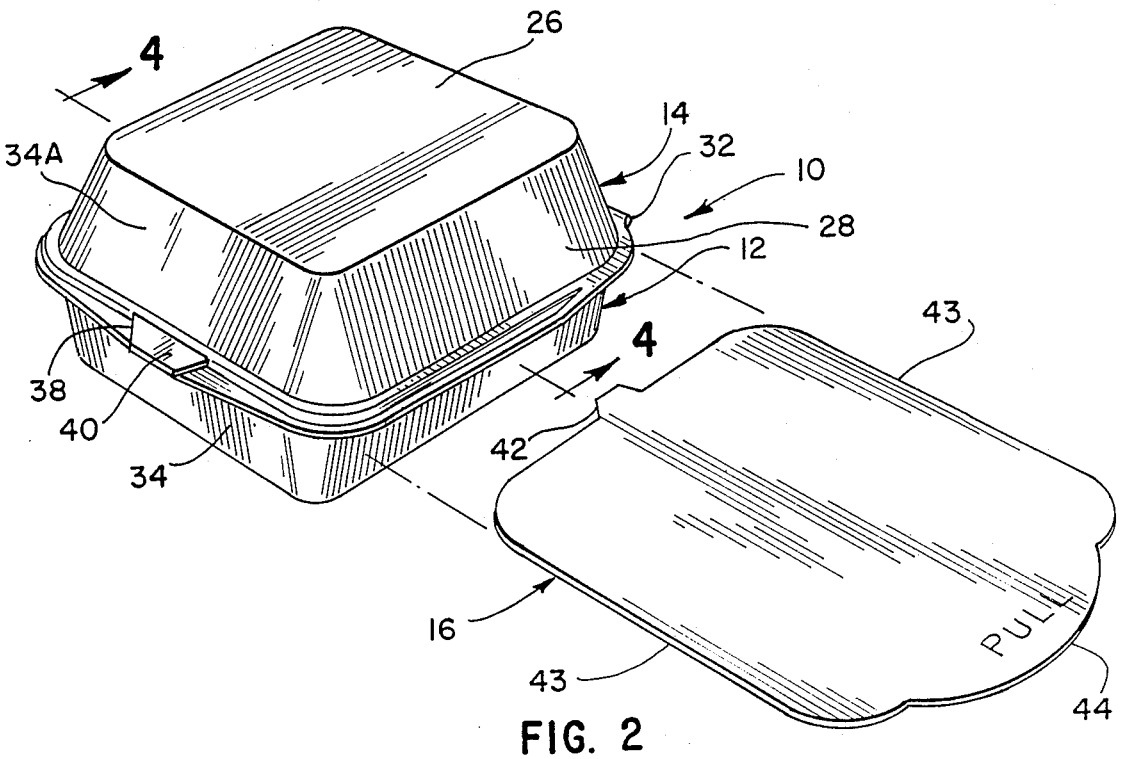
FIG. 2 illustrates in perspective view the container of FIG. 1 where the insert has been removed from the container.
Figure 6:
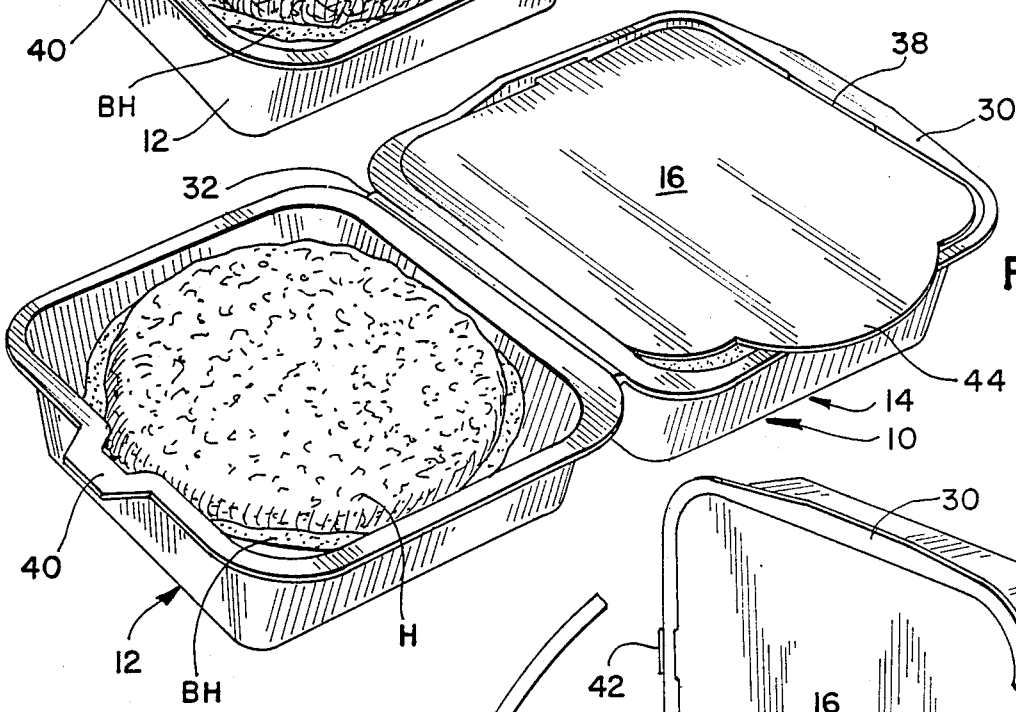
FIG. 6 illustrates in perspective view the container of FIG. 1 containing the top and bottom portions of the sandwich with the insert in position over the top compartment opening.

Insert 16, which in this case is an insulating platform forms part of sandwich container 10 and is more completely illustrated in FIG. 2. Insert 16 generally corresponds to the open portion of bottom and top compartments 12 and 14, respectively, as illustrated in FIG. 6. Insert 16 also includes a support tab 42 and a gripping tab 44, which extends the periphery of insert 16 beyond the otherwise generally corresponding shape described above. Gripping tab 44 may be embossed or otherwise labelled with a suitable legend, such as "PULL" as illustrated in FIGS. 1 and 2. Insert 16 can be of any desired shape. A slot or slots complementary to such support tab or tabs could also be provided in appropriate locations of the container side portions to allow insertion and removal of the support tab(s).

Figure 4:
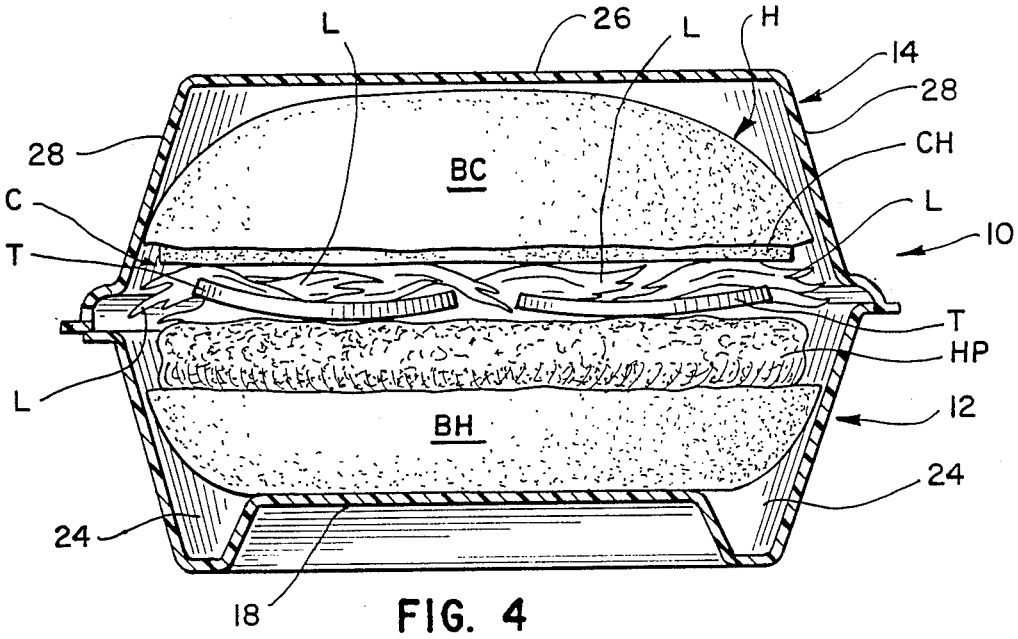
FIG. 4 is a cross-sectional view along lines 4—4 of FIG. 2 wherein the contents of each compartment have been combined after removal of the insert or platform without opening the container.

Support tab 42 is insertable into a complementary slot 46 that is located in side portion 28 of top compartment 14, as illustrated in FIGS. 3–5, which restrains movement of insert 16 relative to side portion 28. When so inserted, support tab 42 rests on side portion 28 of top compartment 14.

Complementary slot 46 can be about the same width and/or height as the width and/or thickness of support tab 42 to provide a snug fit of support tab 42 in complementary slot 46.

Gripping tab 44 preferably extends beyond at least one of side portions 28 and 20 of container 10 to facilitate removal of insert 16 from container 10 when container 10 is in a closed position, as illustrated in FIGS. 1 and 3.

FIG. 3 illustrates in sectional view along lines 3—3 of FIG. 1 sandwich container 10 which contains a hamburger sandwich H therein. Hamburger sandwich H is composed of a bun crown BC, condiments C, which in this case include tomato slices T, lettuce pieces L and a slice of cheese CH. Bun crown BC and condiments C are contained within top compartment 14 of sandwich container 10.

A hamburger patty HP and a bun heel BH are contained within bottom compartment 12 as illustrated in FIG. 3.

In the illustrated embodiment, the contents of the bottom compartment are relatively hot and the contents of the top compartment are relatively cool.

As illustrated in FIG. 3, insert 16 serves to separate and insulate bottom compartment 12 and its contents from top compartment 14 and its contents. Moreover, insert 16 carries the weight of the contents of top compartment 14 since the contents, in this case bun crown BC and condiments C rest on insert 16. The weight of the contents of top compartment 14 and the weight of insert 16 is at least partially carried by side portions 20 and 28 of container 10. The support formed by support tab 42 and gripping tab 44 which transmits at least a portion of the weight to the side portions of sandwich container 10 restrain insert 16 from being displaced into bottom compartment 12. This has the effect of preventing or substantially preventing insert 16 from contacting and deforming the contents of bottom compartment 12, which in this case are hamburger patty HP and bun heel BH.

Support tab 42 and gripping tab 44 provide other advantages as hereinafter described.

When the consumer desires to assemble and consume hamburger sandwich H, insert 16 is removed from container 10 merely by grasping gripping tab 44 and pulling insert 16 in the direction of arrow R without handling by the consumer.

FIG. 4 illustrates sandwich container 10 with insert 16 removed. The effect of removal of insert 16 is to assemble the sandwich by causing the contents of top compartment 14 to contact the contents of bottom compartment 12. In this case, bun crown BC and condiments C of hamburger sandwich H contact hamburger patty HP. Upon opening sandwich container 10 by releasing latch mechanism 36 and lifting and pivoting top compartment 14, hamburger sandwich H is presented in a configuration ready for removal and consumption (not shown).

Figure 7:
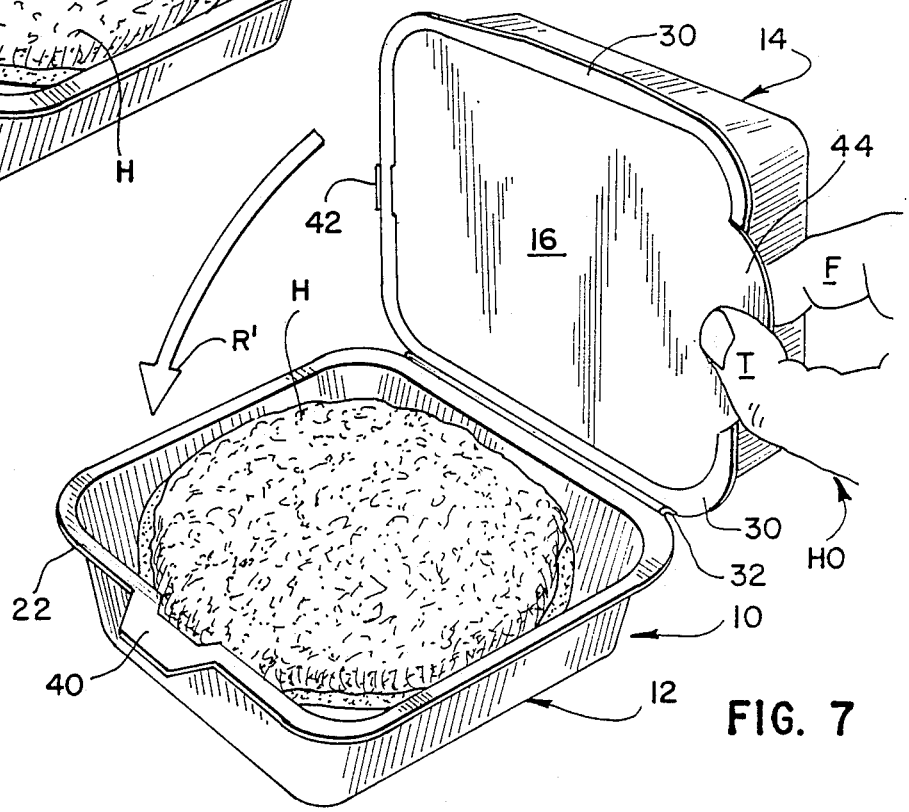
FIG. 7 illustrates in perspective view the container of FIG. 1 being closed after the sandwich and platform insert have been appropriately placed in the container.

The loading and packaging of hamburger sandwich H into sandwich container 10 is illustrated in FIGS. 5–7.

In FIG. 5, sandwich container 10 is in the open position and bun crown BC and condiments C have been placed with the condiments C face up in top compartment 14. Bun heel BH and hamburger patty HP are placed in bottom compartment 12 with hamburger patty HP facing upwardly. After bun crown BC and condiments C are placed in top compartment 14, insert 16 can be placed over top compartment 14, as illustrated in FIG. 6. Insert 16 is placed in position by inserting support tab 42 into complementary slot 46 and otherwise placing insert 16 so that it covers or substantially covers the opening of top compartment 14. Placing insert 16 in position can occur either before or after the loading of bun heel BH and hamburger patty HP, as will be readily appreciated.

After hamburger sandwich H has been loaded into container 10, and insert 16 is in place, container 10 is ready for closing. Closing of container 10 is illustrated in FIG. 7 where a human operator HO grasps gripping tab 44 and lip surface 30 between thumb T and finger F. Top compartment 14 is lifted and rotated about hinge 32 in the direction of arrow R′ while gripping gripping tab 44 and lip surface 30 as aforesaid until top compartment 14 is over bottom compartment 12 and sandwich container 10 is closed. Thereafter, latch mechanism 36 can be engaged by inserting locking wedge 40 into locking aperture 38. Sandwich container 10 with hamburger sandwich H contained therein is ready for storage or delivery to a customer.

Sandwich container 10 can be constructed of materials as desired. Suitable materials include polystyrene, which may be foamed as well as other foamed material. Foamed material is advantageous because of its insulating properties. Other materials can be of course used as those skilled in the art will recognize. For example, other plastics, paper, cardboard and similar materials can be used.

Compartments 12 and 14 can be fabricated from a single piece of material as disclosed in U.S. Pat. No. 4,132,344.

The specific embodiments shown and described are only illustrative of the present invention. Changes in the structure and method of the present invention would be readily apparent to one skilled in the art. For example, a sandwich container in accordance with the invention can be formed of separate top and bottom compartments that are not connected by a hinge but could be connected by, for example, a pair of latch mechanisms which could be similar to latch mechanism 36, one on either side of the container. The shape of the container in accordance with the invention can of course be as desired.

In describing various embodiments herein, the compartments and portions of the container are sometimes referred to as top and bottom. It is to be understood that such relative positions can be reversed or could be otherwise described and the particular orientations utilized herein are for convenience and are not to be construed as a limitation upon the invention.

While the invention has been described with respect to specific embodiments, it is to be understood that the invention is capable of numerous modifications, rearrangements and changes and such modifications, rearrangements and changes are intended to be covered by the scope of the appended claims.

I claim:

1. A container for storing contents in separate compartments comprising:

(a) a first compartment defined by a bottom portion and side portions and having an open portion opposite said bottom portion;

(b) a second compartment defined by a bottom portion and side portions and an open portion opposite said bottom portion, said second compartment being adapted to lie over the open portion of said first compartment with said open portion of said first compartment facing the open portion of said second compartment to close said container;

(c) a removable insert positionable over the open portion of one of said compartments when said container is open, said insert having a periphery and said insert further having a gripping tab that extends the periphery of said insert beyond at least one of the side portions of said container to facilitate removal of said insert when said insert is positioned between said first and second compartments by grasping said tab portion and pulling said insert from said container while said container is closed;

(d) a support tab projecting from the periphery of said insert, opposite said gripping tab, for supporting said insert; and (e) a slot in one of said side portions of said container, said slot located and dimensioned to permit insertion of said supporting tab when said removable insert is in position between said open portions to restrain movement of said insert.

2. The container of claim 1 wherein said supporting tab at least partially supports said removable insert.

3. The container of claim 1 wherein said supporting tab and said gripping tab at least partially supports the weight of said removable insert and the weight of any contents on said insert.

4. The container of claim 1 wherein the weight of said removable insert and the weight of any contents on said insert is at least partially transmitted through said supporting tab and said gripping tab to said side portions of the container.

5. The container of claim 4 wherein said transmission of weight prevents substantial deformation and downward movement of the removable insert thereby avoiding deformation of any contents located in said container below said removable insert.

6. The container of claim 1 wherein said container is adapted for containing a hamburger sandwich comprising from top to bottom, a bun crown, condiments, a hamburger patty and a bun heel, the container being dimensioned so that the first compartment can contain the bun heel and hamburger patty and the second compartment can contain the condiments and bun crown.

7. The container of claim 1 wherein said slot is located in the side portion of said second compartment opposite said gripping tab.

8. The container of claim 7 wherein said first compartment defines a bottom compartment and said second compartment defines a top compartment.

9. The container of claim 1 further comprising hinge means along one side portion of the container hingedly connecting said first and second compartments and allowing the container to be opened by lifting the second compartment up and away from the first compartment and the container can be closed by folding the second compartment over and onto the first compartment while said insert is in position covering the opening of one of said compartments with said support tab disposed within said slot.

10. The container of claim 9 wherein said insert covers the opening of said second compartment.

11. The container of claim 1 further comprising latching means for retaining the container in a closed position.

12. The container of claim 1 wherein said first and second compartments are detachable from each other.

13. The container of claim 1 wherein said container is constructed of polystyrene.

14. The container of claim 1 wherein said container is constructed of foamed material.

15. The container of claim 1 wherein said insert is a platform.

16. The container of claim 15 wherein said platform is an insulating platform for restricting heat transfer from one of said compartments to the other of said compartments.

17. A sandwich package for storing sandwich contents in separate compartments comprising:

(a) a first compartment defined by a bottom portion and side portions and having an open portion opposite said bottom portion;

(b) a second compartment defined by a bottom portion and side portions and having an open portion opposite said bottom portion and a slot in one of said side portions of said second compartment adjacent the open portion of said second compartment;

(c) hinge means connecting side portions of said first and second compartments permitting said second compartment to be folded over and onto said first compartment to define an enclosed volume comprising said first and second compartments with the bottom portion of said second compartment defining the top of said package when closed;

(d) a removable platform positionable over the open portion of said second compartment, said platform having a periphery, a portion of said periphery defining a support tab projecting from said platform, said support tab dimensioned to allow insertion of said tab into said slot when said platform is positioned over said open portion of said second compartment for restraining said platform from movement and for at least partially supporting the weight of said platform and the weight of any contents located in said second compartment and to prevent the contents of said second compartment from moving said platform away from said second compartment when said package is closed by folding said second compartment over and onto said first compartment.

18. The package of claim 17 further comprising a gripping tab extending said periphery of said platform opposite from said support tab beyond at least one of the side portions of said package when said platform is in position in said slot and over the opening of the second compartment, for facilitating removal of said platform from said package when said package is closed and for supporting said platform, in conjunction with said support tab, and for transferring at least a portion of the weight of the platform and any contents in said compartment to the side portions of the package.

19. The package of claim 18 wherein said support tab and said gripping tab prevent said platform from being urged into the first compartment, thereby preventing contact and deformation of any contents contained in said first compartment.

* * * * *